United States Patent [19]

Shoen

[11] Patent Number: 5,061,326

[45] Date of Patent: Oct. 29, 1991

[54] METHOD OF MAKING HIGH SILICON, LOW CARBON REGULAR GRAIN ORIENTED SILICON STEEL

[75] Inventor: Jerry W. Shoen, Middletown, Ohio

[73] Assignee: Armco Inc., Middletown, Ohio

[21] Appl. No.: 549,614

[22] Filed: Jul. 9, 1990

[51] Int. Cl.[5] ..... C21D 8/14

[52] U.S. Cl. ..... 148/12.4; 148/12 A

[58] Field of Search ..... 148/111, 112, 113, 12 A, 148/12.4

[56] References Cited

U.S. PATENT DOCUMENTS 3,021,237 2/1962 Henke ..... 148/12 A 4,390,378 6/1983 Rastogi ..... 148/12 A

FOREIGN PATENT DOCUMENTS 59-190324 10/1984 Japan ..... 148/112

*Primary Examiner*—Deborah Yee

*Attorney, Agent, or Firm*—Frost & Jacobs

[57] ABSTRACT

A process of producing high silicon, low melt carbon regular grain electrical silicon steel having a final gauge of from 14 mils (0.35 mm) to about 6 mils (0.15 mm) or less, including the steps of providing a hot band and removing the hot band scale, if needed. The silicon steel is cold rolled to intermediate gauge and subjected to an intermediate anneal at a soak temperature of about 1650° F. (900° C.) to about 1700° F. (930° C.). Thereafter, the silicon steel is cooled in a first stage slow cooling at a rate of about 500° F. (280° C.) to about 1050° F. (585° C.) per minute down to about 1100° F.±50° F. (595° C.±30° C.). The silicon steel is then subjected to a second stage fast cooling down to from about 600° F. (315° C.) to about 1000° F. (540° C.) at a cooling rate of from about 2500° F. (1390° C.) to about 3500° F. (1945° C.) per minute followed by a water quench. The silicon steel is cold rolled to final gauge, decarburized, coated with an annealing separator and final annealed. Preferably, but optionally, the hot band is annealed prior to the first cold rolling. Preferably, but optionally, the final gauge silicon steel prior to decarburization is subject to an ultra-rapid annealing treatment at a rate greater than 180° F. (100° C.) per second to a temperature greater than 1250° F. (675° C.).

18 Claims, 1 Drawing Sheet

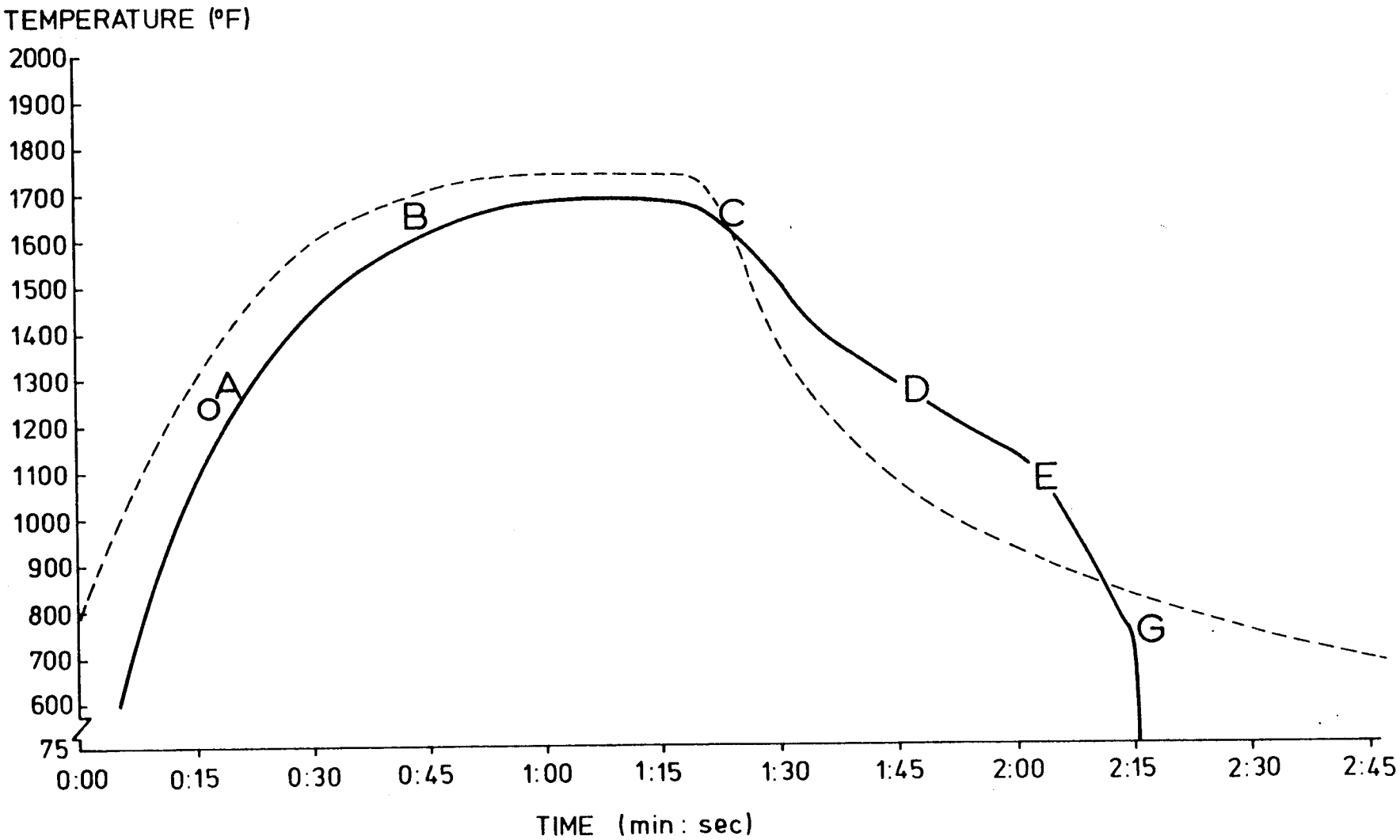
TEMPERATURE (°F)
2000
1900
1800
1700
1600
1500
1400
1300
1200
1100
1000
900
800
700
600
75
0:00
0:15
0:30
0:45
1:00
1:15
1:30
1:45
2:00
2:15
2:30
2:45
TIME (min : sec)
A
B
C
D
E
G

METHOD OF MAKING HIGH SILICON, LOW CARBON REGULAR GRAIN ORIENTED SILICON STEEL

TECHNICAL FIELD

The invention relates to a process for producing high silicon regular grain oriented electrical steel with low melt carbon and in thicknesses ranging from about 14 mils (0.35 mm) to about 6 mils (0.15 mm) or less, and more particularly to such a process including an intermediate anneal following the first cold rolling stage having a very short soak time and a two-part temperature-controlled cooling cycle, and preferably an ultra-rapid anneal prior to decarburization.

BACKGROUND ART

The teachings of the present invention are applied to silicon steel having a cube-on-edge orientation, designated (110) by Miller's Indices Such silicon steels are generally referred to as grain oriented electrical steels. Grain oriented electrical steels are divided into two basic categories: regular grain oriented and high permeability grain oriented. Regular grain oriented electrical steel utilizes manganese and sulfur (and/or selenium) as the principle grain growth inhibitor and generally has a permeability at 796 A/m of less than 1870. High permeability electrical steel relies on aluminum nitrides, boron nitrides or other species known in the art made in addition to or in place of manganese sulphides and/or selenides as grain growth inhibitors and has a permeability greater than 1870. The teachings of the present invention are applicable to regular grain oriented silicon steel.

Conventional processing of regular grain oriented electrical steel comprises the steps of preparing a melt of electrical steel in conventional facilities, refining and casting the electrical steel in the form of ingots or strand cast slabs. The cast electrical steel preferably contains in weight percent less than about 0.1% carbon, about 0.025% to about 0.25% manganese, about 0.01% to 0.035% sulfur and/or selenium, about 2.5% to about 4.0% silicon with an aim silicon content of about 3.15%, less than about 50 ppm nitrogen and less than about 100 ppm total aluminum, the balance being essentially iron. Additions of boron and/or copper can be made, if desired.

If cast into ingots, the steel is hot rolled into slabs or directly rolled from ingots to strip. If continuous cast, the slabs may be pre-rolled in accordance with U.S. Pat. No. 4,718,951. If developed commercially, strip casting would also benefit from the process of the present invention. The slabs are hot rolled at about 2550° F. (1400° C.) to hot band thickness and are subjected to a hot band anneal of about 1850° F. (1010° C.) with a soak of about 30 seconds. The hot band is air cooled to ambient temperature. Thereafter, the material is cold rolled to intermediate gauge and subjected to an intermediate anneal at a temperature of about 1740° F. (950° C.) with a 30 second soak and is cooled as by air cooling to ambient temperature. Following the intermediate anneal, electrical steel is cold rolled to final gauge. The electrical steel at final gauge is subjected to a conventional decarburizing anneal which serves to recrystallize the steel, to reduce the carbon content to a nonaging level and to form a fayalite surface oxide. The decarburizing anneal is generally conducted at a temperature of from about 1525° F. to about 1550° F. (about 830° C. to about 845° C.) in a wet hydrogen bearing atmosphere for a time sufficient to bring the carbon content down to about 0.003% or lower. Thereafter, the electrical steel is coated with an annealing separator such as magnesia and is final annealed at a temperature of about 2200° F. (1200° C.) for twenty-four hours. This final anneal brings about secondary recrystallization. A forsterite or "mill" glass coating is formed by reaction of the fayalite layer with the separator coating.

Representative processes for producing regular grain oriented (cube-on-edge) silicon steel are taught in U.S. Pat. Nos. 4,202,711; 3,764,406; and 3,843,422.

In recent years, to lower the core loss of regular grain oriented products, attention has been turned to increasing the volume resistivity by raising the silicon content to suppress macro-eddy current losses. However, the expected improvement from higher silicon content has generally not been realized. A typical prior art approach has been to increase both silicon and carbon in particular ratios in an attempt to achieve improved magnetic quality. It has been found that raising carbon and silicon together will make the steel more prone to incipient grain boundary melting during the high temperature ingot/slab heating process and more brittle in subsequent processing after hot rolling. Particularly the handling and cold rolling characteristics of the higher silicon and carbon material are degraded. In the process of making regular grain oriented silicon steel, decarburization to 0.003% carbon or less is required to provide nonaging magnetic properties in the finished grain oriented electrical steel. However, higher silicon retards decarburization, making high silicon, high melt carbon materials more difficult to produce.

The present invention is based upon the discovery that in the production of regular grain oriented electrical steel the nature of the intermediate anneal following first stage of cold rolling, and its cooling cycle, have a marked effect on the magnetic quality of the final product. The volume fraction of austenite formed during the anneal, the austenite decomposition product and the carbide precipitate formed during cooling are all of significant importance. A cooling rate after the intermediate anneal which does not allow for austenite decomposition subsequent to the precipitation of fine iron carbide produces lower permeability, less stable secondary grain growth, and/or an enlarged secondary grain size. Added to this, higher silicon will raise the activity of carbon, increasing the carbide precipitation temperature and producing a coarser carbide. As a result, the problems created by improper cooling after the intermediate anneal are aggravated at higher silicon. The teachings of the present invention overcome these problems.

The present invention is directed to the production of regular grain oriented silicon steel starting with a melt chemistry having a silicon content of from about 3% to about 4.5% and a low carbon content of less than 0.07%. The routing of The present invention follows the conventional routing given above with three exceptions. First of all, the hot band anneal can be eliminated. This is particularly true at the lower end of the above given silicon content range. Preferably, however, the routing of the present invention includes such a hot band anneal.

Second, the present invention contemplates a modified intermediate anneal procedure following the first stage of cold rolling. The modified intermediate anneal procedure preferably has a short soak at a lower temperature than the typical prior art intermediate anneal and includes a temperature controlled, two-stage cooling cycle, as will be fully described hereinafter.

The intermediate anneal cooling practice of the present invention provides for austenite decomposition in the first slow stage of cooling prior to precipitation of fine iron carbide in the second rapid stage of cooling. The short soak feature and austenite decomposition are facilitated by the low melt carbon.

Finally, the routing of the present invention preferably includes an ultra-rapid annealing treatment prior to decarburization. The ultra-rapid annealing treatment improves the overall magnetic quality by improving the recrystallization texture. The ultra-rapid annealing treatment is of the type set forth in U.S. Pat. No. 4,898,626, the teachings of which are incorporated herein by reference.

Briefly, U.S. Pat. No. 4,898,626 teaches that the ultra-rapid annealing treatment is performed by heating the electrical steel at a rate in excess of 180° F. (100° C.) per second to a temperature above the recrystallization temperature, nominally 1250° F. (675° C.). The ultra-rapid annealing treatment can be performed at any point in the routing after at least a first stage of cold rolling and before the decarburization anneal preceding the final anneal. A preferred Point in the routing is after the completion of cold rolling and before the decarburization anneal. The ultra-rapid annealing treatment may be accomplished either prior to the decarburization anneal, or may be incorporated into the decarburization anneal as a heat-up portion thereof.

DISCLOSURE OF THE INVENTION

According to the invention there is provided a method for processing regular grain oriented silicon steel having a thickness in the range of from about 14 mils (0.35 mm) to about 6 mils (0.15 mm) or less comprising the steps of providing electrical steel consisting essentially of, in weight percent, less than about 0.07% carbon, about 0.025% to 0.25% manganese, about 0.01% to 0.035% sulfur and/or selenium, about 3.0% to 4.5% silicon, less than about 100 ppm total aluminum, less than about 50 ppm nitrogen, the balance being essentially iron. Additions of boron and/or copper can be made, if desired.

To this end, the starting material referred to as "hot band" can be produced by a number of methods known in the art such as ingot casting/continuous casting and hot rolling, or by strip casting.

The hot band is subjected to an anneal at about 1850° F. (1010° C.) for a soak time of about 30 seconds, followed by air cooling to ambient temperature. It has been found that this hot band anneal can be omitted, particularly when making a regular grain oriented electrical steel having a silicon content at the lower portion of the range.

Thereafter, the electrical steel is cold rolled to intermediate gauge. The cold rolled intermediate thickness electrical steel is subjected to an intermediate anneal at about 1650° F. to about 2100° F. (about 900° C. to about 1150° C.) and preferably from about 1650° F. to about 1700° F. (from about 900° C. to about 930° C.) for a soak time of from about 1 to about 30 seconds, and preferably from about 3 to about 8 seconds. Following this soak, the electrical steel is cooled in two stages. The first is a slow cooling stage from soak temperature to a temperature of from about 1000° F. to about 1200° F. (about 540° C. to about 650° C.), and preferably to a temperature of 1100° F. ± 50° F. (595° C. ± 30° C.) at a rate less than about 1500° F. (835° C.) per minute, and preferably at a rate of from about 500° F. (280° C.) to 1050° F. (585° C.) per minute. The second stage is a fast cooling stage at a rate of greater than 1500° F. (835° C.) per minute and preferably at a rate of 2500° F. to about 3500° F. (1390° C. to 1945° C.) per minute, followed by a water quench at about 600° F. to about 1000° F. (about 315° C. to about 540° C.). Following the intermediate anneal, the electrical steel is cold rolled to final gauge, decarburized, coated with an annealing separator, and subjected to a final anneal to effect secondary recrystallization.

In a preferred practice of the invention, the electrical steel is subjected to an ultra-rapid annealing treatment of the type described above. This can be performed at any point in the routing after at least a first stage of cold rolling, and before decarburization. It is generally preferred to perform the ultra-rapid annealing treatment upon completion of cold rolling and before the decarburization anneal. As indicated above, the ultra-rapid anneal may be incorporated into the decarburization annealing step as a heat-up portion thereof.

BRIEF DESCRIPTION OF THE DRAWING

The Figure is a graph illustrating the intermediate anneal time/temperature cycle of the present invention and of a typical prior art intermediate anneal.

DESCRIPTION OF THE PREFERRED EMBODIMENTS

In the practice of the present invention, the routing for the high silicon, low melt carbon regular grain oriented electrical steel is conventional and is essentially the same as that given above with three exceptions. The first exception is that the hot band anneal can be omitted, if desired. Where equipment and conditions permit, the practice of a hot band anneal is recommended since it makes the high silicon regular grain oriented electrical steel less brittle and more amenable to cold rolling. Furthermore, it tends to contribute to more stable secondary recrystallization. When practiced, a hot band anneal is provided at a temperature of about 1850° F. (1010° C.) at a soak time of about 30 seconds. The hot band anneal is followed by air cooling to ambient temperature. The second exception is the development of the intermediate anneal and cooling practice of the present invention following the first stage of cold rolling. Finally, the third exception is the optional, but preferred, use of an ultra-rapid annealing treatment prior to decarburization.

Following the first stage of cold rolling, the silicon steel is subjected to an intermediate anneal in accordance with the teachings of the present invention. Reference is made to the Figure, which is a schematic of the time/temperature cycle for the intermediate anneal of the present invention. The Figure also shows, with a broken line, the time/temperature cycle for a typical, prior art intermediate anneal.

A primary thrust of the present invention is the discovery that the intermediate anneal and its cooling cycle can be adjusted to provide a fine carbide dispersion. The anneal and its cooling cycle overcome the adverse effects of a higher silicon content, described above.

During the heat-up portion of the intermediate anneal, recrystallization occurs at about 1250° F. (675° C.), roughly 20 seconds after entering the furnace, after which normal grain growth occurs. The start of recrystallization is indicated at "0" in the Figure. Above about 1280° F. (690° C.) carbides will begin dissolving, as indicated at "A" in the Figure. This event continues and accelerates as the temperature increases. Above about 1650° F. (900° C.), a small amount of ferrite transforms to austenite. The austenite provides for more rapid solution of carbon and restricts normal grain growth, thereby establishing the intermediate annealed grain size. Prior art intermediate anneal practice provided a soak at about 1740° F. (950° C.) for a period of at least 25 to 30 seconds. The intermediate anneal procedure of the present invention provides a soak time of from about 1 to about 30 seconds, and preferably from about 3 to 8 seconds. The soak temperature has been determined not to be critical. The soak can be conducted at a temperature of from about 1650° F. (900° C.) to about 2100° F. (1150° C.). Preferably, the soak is conducted at a temperature of from about 1650° F. (900° C.) to about 1700° F. (930° C.), and more preferably at about 1680° F. (915° C.). The shorter soak time and the lower soak temperature are preferred because less austenite is formed. Further, the austenite present in the form of dispersed islands at the prior ferrite grain boundaries is finer. Thus, the austenite is easier to decompose into ferrite with carbon in solid solution for subsequent precipitation of fine iron carbide. To extend either the soak temperature or time results in the enlargement of the austenite islands which rapidly become carbon-rich compared to the prior ferrite matrix. Both growth and carbon enrichment of the austenite hinder its decomposition during cooling. The desired structure exiting the furnace consists of a recrystallized matrix of ferrite having less than about 5% austenite uniformly dispersed throughout the material as fine islands. At the end of the anneal, the carbon will be in solid solution and ready for reprecipitation on cooling. The primary reason behind the redesign of the intermediate anneal time and temperature at soak is the control of the growth of the austenite islands. The lower temperature reduces the equilibrium volume fraction of austenite which forms. The shorter time reduces carbon diffusion, thereby inhibiting growth and undue enrichment of the austenite. The lower strip temperature, the reduced volume fraction and the finer morphology of the austenite make it easier to decompose during the cooling cycle.

Immediately after the soak, the cooling cycle is initiated. The cooling cycle of the present invention contemplates two stages. The first stage extending from soak to the point "E" on the Figure is a slow cool from soak temperature to a temperature of from about 1000° F. (540° C.) to about 1200° F. (650° C.) and preferably to about 1100° F. ± 50° F. (595° C. ± 30° C.). This first slow cooling stage provides for the decomposition of austenite to carbon-saturated ferrite. Under equilibrium conditions, austenite decomposes to carbon-saturated ferrite between from about 1650° F. (900° C.) and 1420° F. (770° C.). However, the kinetics of the cooling process are such that austenite decomposition does not begin in earnest until the mid 1500° F. (815° C.) range and continues somewhat below 1100° F. (595° C.).

Failure to decompose the austenite in the first cooling stage will result in the formation of martensite and/or pearlite. Martensite, if present, will cause an enlargement of the secondary grain size, and the deterioration of the quality of the (110) orientation. Its presence adversely affects energy storage in the second stage of cold rolling, and results in poorer and more variable magnetic quality of the final electrical steel product. Lastly, martensite degrades the mechanical properties, particularly the cold rolling characteristics. Pearlite is more benign, but still ties up carbon in an undesired form.

As indicated above, austenite decomposition begins at about point "C" in the Figure and continues to about point "E". At point "D" fine iron carbide begins to precipitate from the carbon-saturated ferrite. Under equilibrium conditions, carbides begin to precipitate from carbon-saturated ferrite at temperatures below 1280° F. (690° C.). However, the actual process requires some undercooling to start precipitation, which begins in earnest at about 1200° F. (650° C.). It will be noted that the austenite decomposition to carbon-rich ferrite and carbide precipitation from the ferrite overlap somewhat. The carbide is in two forms. It is present as an intergranular film and as a fine intragranular precipitate. The former precipitates at temperatures above about 1060° F. (570° C.). The latter precipitates below about 1060° F. (570° C.). The slow cooling first stage, extending from point "C" to point "E" of the Figure has a cooling rate of less than 1500° F. (835° C.) per minute, and preferably from about 500° F. to about 1050° F. (280° C. to 585° C.) per minute.

The second stage of the cooling cycle, a fast cooling stage, begins at point "E" in the Figure and extends to point "G" between 600° F. and 1000° F. (315° C. and 540° C.) at which point the strip can be water quenched to complete the rapid cooling stage. The strip temperature after water quenching is 150° F. (65° C.) or less, which is shown in the Figure as room temperature (75° F. or 25° C.). During the second cooling stage, the cooling rate is preferably from about 2500° F. to about 3500° F. (1390° C. to 1945° C.) per minute and preferably greater than 3000° F. (1665° C.) per minute. This assures the precipitation of fine iron carbide.

It will be evident from the above that the entire intermediate anneal and cooling cycle of the present invention is required in the process of obtaining the desired microstructure, and precise controls are critical. The typical prior art cycle time shown in the Figure required at least 3 minutes, terminating in a water bath, not shown, at a strip speed of about 220 feet per minute (57 meters per minute). The intermediate anneal cycle time of the present invention requires about 2 minutes, 10 seconds which enabled a strip speed of about 260 feet per minute (80 meters per minute) to be used. It will therefore be noted that the annealing cycle of the present invention enables greater productivity of the line. No aging treatment after the anneal is either needed or desired, since it has been found to cause the formation of an enlarged secondary grain size which degrades the magnetic quality of the final electrical steel product.

The intermediate anneal is followed by the second stage of cold rolling reducing the electrical steel to the desired final gauge. At this stage, the electrical steel can be decarburized, coated with an annealing separator and subjected to a final anneal to effect secondary recrystallization.

In the preferred practice of the present invention, the electrical steel is given an ultra-rapid annealing treatment after cold reduction and prior to decarburization. To this end, the electrical steel at final gauge is heated at a rate above 180° F. (100° C.) per second to a temperature above 1250° F. (675° C.). Preferably, the electrical steel is heated at a rate of 1000° F. (540° C.) per second. It is additionally preferred that the ultra-rapid annealing treatment be performed as a heat-up portion of the decarburizing anneal.

The preferred chemistry of the present invention in weight percent is as follows: less than 0.05% carbon, about 0.04% to about 0.08% manganese, about 0.015% to about 0.025% sulfur and/or selenium, about 3.25% to about 3.75% silicon, less than 100 ppm aluminum, less than 50 ppm nitrogen, addition of boron and/or copper if desired the balance being essentially iron.

The ultra-rapid annealing treatment improves the recrystallization texture after decarburization by creating more (110) primary grains. It also contributes to smaller secondary grain size. When an ultra-rapid annealing treatment is incorporated into the process, the process is less sensitive to intermediate and final gauge variations and the magnetic characteristics of the regular grain oriented silicon steel are improved and more consistent.

EXAMPLE I

Four heats were melted having the compositions in weight percent shown in Table I. The heats were prepared by continuous casting into 8" (200 mm) thick slabs, prerolling the 8" thick slabs to 6" (150 mm), reheating to 2550° F. (1400° C.) and hot rolling to 0.084" (2.1 mm) hot bands for subsequent processing. The plant processing followed a routing using a 1850° F. (1010° C.) hot band annealing treatment and cold rolling to various intermediate thicknesses; however, Heats A and B were processed using a typical Prior art intermediate anneal with a 1740° F. (950° C.) soak for 25–30 seconds followed by normal ambient cooling while Heats C and D were intermediate annealed according to the practice of the present invention After intermediate annealing, the materials were cold rolled to final thicknesses of 7-mils (0.18 mm) and 9-mils (0.28 mm). After completing cold rolling, the materials were decarburized at 1525° F. (830° C.) in a wet hydrogen-bearing atmosphere, MgO coated and given a final anneal at 2200° F. (1200° C.). The resulting magnetic quality obtained in these trials are summarized in Table III.

TABLE I

| Code | C | Mn | S | Si | Al | Cu | P | N |
|---|---|---|---|---|---|---|---|---|
| A | 0.0288 | 0.059 | 0.0198 | 3.41 | 0.0013 | 0.092 | 0.006 | 0.0042 |
| B | 0.0296 | 0.059 | 0.0209 | 3.42 | 0.0014 | 0.118 | 0.006 | 0.0038 |
| C | 0.0265 | 0.058 | 0.0218 | 3.44 | 0.0012 | 0.097 | 0.005 | 0.0040 |
| D | 0.0274 | 0.058 | 0.0212 | 3.36 | 0.0012 | 0.085 | 0.006 | 0.0035 |

TABLE II

| | Heat | Hot Band End | Intermediate Thickness | P15 | H-10 | Intermediate Thickness | P15 | H-10 |
|---|---|---|---|---|---|---|---|---|
| Conventional Practice: | A | Front | 0.020" | 0.393 | 1842 | 0.022" | 0.413 | 1849 |
| | | Back | " | 0.396 | 1833 | " | 0.442 | 1831 |
| | B | Front | " | 0.399 | 1842 | " | 0.432 | 1842 |
| | | Back | " | 0.420 | 1824 | " | 0.430 | 1840 |
| Present Invention with Conventional Decarburization: | C | Front | 0.019" | 0.383 | 0844 | 0.021" | 0.411 | 1845 |
| | | Back | " | 0.380 | 1838 | " | 0.412 | 1843 |
| | D | Front | " | 0.376 | 1845 | " | 0.408 | 1844 |
| | | Back | " | 0.381 | 1840 | " | 0.410 | 1840 |
| | C | Front | 0.021" | 0.373 | 1841 | 0.023" | 0.411 | 1846 |
| | | Back | " | 0.380 | 1838 | " | 0.423 | 1836 |
| | D | Front | " | 0.368 | 1849 | " | 0.402 | 1849 |
| | | Back | " | 0.379 | 1840 | " | 0.405 | 1846 |
| | C | Front | 0.025" | 0.376 | 1838 | 0.025" | 0.405 | 1844 |
| | | Back | " | 0.376 | 1840 | " | 0.407 | 1846 |
| | D | Front | " | 0.377 | 1841 | " | 0.405 | 1846 |
| | | Back | " | 0.376 | 1837 | " | 0.406 | 1845 |
| Averages: Conventional Practice | | | 0.022" | 0.402 | 1835 | | 0.429 | 1841 |
| Present Invention: | | | 0.019" | 0.380 | 1842 | | 0.410 | 1843 |
| Present Invention: | | | 0.021" | 0.375 | 1842 | | 0.410 | 1844 |
| Present Invention: | | | 0.025" | 0.376 | 1839 | | 0.406 | 1845 |
| Improvement of Present Invention: | | | 5.5% | | | | 4.4% | |
| | | | 6.7% | | | | 4.5% | |
| | | | 6.4% | | | | 5.5% | |

The results clearly show that the practice of the intermediate anneal cycle of the present invention provided improved core loss and enhanced stability of secondary grain growth for these regular grain oriented materials.

EXAMPLE II

Additional samples from Heats A and B were secured during plant processing trials for laboratory processing. Plant processing followed the conventional routing of example I; however, after cold rolling to intermediate thickness was completed, the samples were secured in the plant and processed in the laboratory in accordance with the teachings of the present invention wherein the intermediate annealing soak temperatures and times and controlled cooling practice were employed and the more preferred practice utilizing an ultra-rapid annealing treatment after completion of cold rolling and prior to decarburization was employed. In the practice of the latter, a 1000° F. (556° C.) per second heating rate from room temperature to 1375° F. was incorporated into the heat-up portion of the decarburization anneal. After the intermediate anneal, the materials were cold rolled to 7-mils (0.18 mm) final thickness and decarburized at 1525° F. (830° C.) in a wet hydrogen-bearing atmosphere using either conventional techniques and ultra-rapid annealing treatment during heating. After decarburization, the samples were MgO coated and given a final anneal at 2200° F. (1200° C.). The results of these runs are summarized in Table III.

TABLE III

| | Heat | Hot Band End | Intermediate Thickness | P15 | H10 |
|---|---|---|---|---|---|
| Conventional Practice: | A | Front | 0.020" | 0.395 | 1847 |
| | | Back | " | 0.391 | 1837 |

TABLE III-continued

| | Heat | Hot Band End | Intermediate Thickness | P15 | H10 |
|---|---|---|---|---|---|
| | B | Front | " | 0.399 | 1842 |
| | | Back | " | 0.420 | 1824 |
| Present Invention | A | Front | 0.021" | 0.368 | 1846 |
| w/Conventional | | Back | to | 0.359 | 1850 |
| Decarburization: | B | Front | 0.024" | 0.372 | 1855 |
| | | Back | | 0.363 | 1855 |
| Present Invention | A | Front | 0.021" | 0.355 | 1853 |
| w/Ultra-Rapid | | Back | to | 0.350 | 1856 |
| Annealing: | B | Front | 0.024" | 0.359 | 1859 |
| | | Back | | 0.353 | 1857 |
| Conventional practice | | | | 0.401 | 1838 |
| Pres. Invention - Conventional Decarburization | | | | 0.366 | 1857 |
| Pres. Invention - Ultra-Rapid Annealing | | | | 0.354 | 1856 |
| Improvement of Present Invention: | | | | 8.9% | |
| | | | | 11.7% | |

The results clearly show that the practice of the intermediate anneal cycle of the present invention provided improved core loss and enhanced the stability of secondary grain growth for these regular grain oriented materials. The more preferred practice whereby an ultra-rapid annealing treatment in addition to the intermediate anneal cycle of the present invention further provided for still more improvement in the magnetic quality.

Modifications may be made in the invention without departing from the spirit of it.

What is claimed is:

1. A process for producing high silicon, low melt carbon, regular grain oriented electrical steel having a thickness of from about 14 mils (0.35 mm) to about 6 mils (0.15 mm) or less, comprising the steps of providing a hot band of silicon steel containing in weight percent from about 3.0% to about 4.5% silicon and less than 0.07% carbon, annealing said hot band, removing the hot band scale if required, cold rolling to intermediate gauge, subjecting said intermediate gauge material to an intermediate anneal at a soak temperature of from about 1650° F. (900° C.) to about 2100° F. (1150° C.) for a soak time of from about 1 second to about 30 seconds, conducting a slow cooling stage from said soak temperature to a temperature of from about 1000° F. (540° C.) to about 1200° F. (650° C.) at a cooling rate of less than 1500° F. (835° C.) per minute, thereafter conducting a fast cooling stage to a temperature of from about 600° F. (315° C.) to about 1000° F. (540° C.) at a rate greater than 1500° F. (835° C.) per minute followed by a water quench, cold rolling said silicon steel to final gauge, subjecting said final gauge silicon steel to a decarburizing anneal, coating said decarburized silicon steel with an annealing separator, and subjecting said silicon steel to a final anneal to effect secondary recrystallization.

2. The process claimed in claim 1 wherein said silicon content in weight percent is about 3.25%–3.75%.

3. The process claimed in claim 1 wherein said hot band anneal is conducted at a temperature of about 1850° F. (1010° C.) with a soak time of about 30 second and air cooling to ambient temperature.

4. The process in claim 1 including the step of subjecting said silicon steel at a final gauge and before decarburization to an ultra-rapid annealing treatment to a temperature greater than 1250° F. (675° C.) at a heating rate greater than 180° F. (100° C.) per second.

5. The process claimed in claim 1 including the step of conducting said intermediate anneal with a soak time of from about 3 to about 8 seconds.

6. The process claimed in claim 1 including the step of conducting said intermediate anneal at a soak temperature of from about 1650° F. (900° C.) to about 1700° F. (930° C.).

7. The process claimed in claim 1 including the step of conducting said intermediate anneal at a soak temperature of about 1680° F. (915° C.).

8. The process claimed in claim 1 including the step of terminating said slow cooling stage at a temperature of about 1100° F. ± 50° F. (595° C. ± 30° C.).

9. The process claimed in claim 1 including the step of conducting said slow cooling stage at a cooling rate of from about 500° F. (280° C.) to about 1050° F. (585° C.) per minute.

10. The process claimed in claim 1 including the step of conducting said fast cooling stage at a cooling rate of about 2500° F. (1390° C.) to about 3500° F. (1945° C.) per minute.

11. The process claimed in claim 1 including the steps of conducting said intermediate anneal with a soak temperature of about 1680° F. (915° C.) for a soak time of about 3 to about 8 seconds, conducting said slow cooling stage at a cooling rate of about 500° F. (280° C.) to about 1050° F. (585° C.) per minute, terminating said slow cooling stage at a temperature of about 1100° F. ± 50° F. (595° C. ± 30° C.), and conducting said fast cooling stage at a rate of from about 2500° F. (1390° C.) to about 3500° F. (1945° C.) per minute.

12. The process claimed in claim 1 wherein said silicon steel consists essentially of, in weight percent, less than 0.07% carbon, about 0.025% to 0.25% manganese, about 0.01% to 0.035% sulfur and/or selenium, about 3.0% to about 4.5% silicon, less than 100 ppm aluminum, less than 50 ppm nitrogen, additions of boron and/or copper, if desired, the balance being essentially iron.

13. The process claimed in claim 11 including the step of subjecting said silicon steel at final gauge and before decarburization to an ultra-rapid annealing treatment at a temperature greater than 1250° F. (675° C.) at a heating rate greater than 180° F. (100° C.) per second.

14. The process claimed in claim 11 wherein said hot band anneal is conducted at a temperature of about 1850° F. (1010° C.) with a soak of about 30 seconds and air cooling to ambient temperature.

15. The process claimed in claim 13 including the step of performing said ultra-rapid annealing treatment as a heat-up portion of said decarburizing anneal.

16. The process claimed in claim 14 including the step of subjecting said silicon steel at final gauge and before decarburization to an ultra-rapid annealing treatment to a temperature greater than 1250° F. (675° C.) at a heating rate greater than 180° F. (100° C.) per second.

17. The process claimed in claim 16 including the step of performing said ultra-rapid annealing treatment as a heat-up portion of said decarburizing anneal.

18. The process claimed in claim 1 wherein said silicon steel consists essentially of, in weight percent, less than 0.05% carbon, about 0.04% to 0.08% manganese, about 0.015% to 0.025% sulfur and/or selenium, about 3.25% to about 3.75% silicon, less than 100 ppm aluminum, less than 50 ppm nitrogen, additions of boron and/or copper, if desired, the balance being essentially iron.

* * * * *